US005094718A

United States Patent [19]

Friend

[11] Patent Number: 5,094,718

[45] Date of Patent: Mar. 10, 1992

[54] METHOD AND APPARATUS FOR CONTROL OF WEB FLUTTER

[75] Inventor: William H. Friend, Savannah, Ga.

[73] Assignee: Union Camp Corporation, Wayne, N.J.

[21] Appl. No.: 597,104

[22] Filed: Oct. 12, 1990

Related U.S. Application Data

[63] Continuation of Ser. No. 317,151, Feb. 27, 1989, abandoned.

[51] Int. Cl.[5] ..... D21F 7/06

[52] U.S. Cl. ..... 162/198; 162/256; 162/262; 162/263; 73/37.7; 73/159; 226/100; 242/57

[58] Field of Search ..... 162/198, 263, 256, 255, 162/273, 262; 73/37.6, 37.7, 159; 242/57; 226/100

[56] References Cited

U.S. PATENT DOCUMENTS 4,031,741 6/1977 Schaming ..... 73/37.7

4,496,428 1/1985 Wells ..... 162/256

FOREIGN PATENT DOCUMENTS 904574 7/1972 Canada ..... 162/255

*Primary Examiner*—Steve Alvo

*Attorney, Agent, or Firm*—William K. Wissing

[57] ABSTRACT

An apparatus and method for suppressing flutter of a moving web manufacturing operation to include a sensor for sensing the pressure of air in a region proximate the web, which sensor generates a pressure signal representative of the air pressure, a signal processor, connected to receive the pressure signal and to derive therefrom a negative feedback suppression signal phase-shifted to attenuate the air pressure, and an air modulator, positioned to modulate the air in the region proximate the web, which modulator receives the suppression signal and modulates air in response thereto so that flutter is attenuated. The modulator can be a speaker placed in an air supply duct, and in another embodiment it is placed directly in a web pocket.

7 Claims, 3 Drawing Sheets

METHOD AND APPARATUS FOR CONTROL OF WEB FLUTTER

This is a continuation of application Ser. No. 317,151, filed Feb. 27, 1989, now abandoned.

FIELD OF THE INVENTION

The present invention relates to the field of manufacturing web products, and more particularly to methods and apparatus for monitoring and controlling web flutter during the manufacturing process.

BACKGROUND OF THE INVENTION

In the manufacture of web based products, such as paper, textiles and certain plastics, a web of material is moved along a serpentine path through various stations wherein a different manufacturing operation is performed on the web at each station. A web moving through such a path can measure several hundred feet in length and can measure several feet in width. Should the web break during the manufacturing process, significant downtime can occur while the web is rethreaded through the different stations. As will be appreciated, such downtime can result in substantial cost to the manufacturer. An additional consequence of a web break is the detrimental effect on product quality if breaks are occurring too frequently.

Therefore, a need exists in the manufacture of web based products for methods and apparatus for preventing web breaks. One invention directed towards this problem is described and claimed in a copending application entitled, METHOD AND APPARATUS FOR DETERMINING WEB FLUTTER, Ser. No. 192,255, filed May 10, 1988, owned by the assignee of the present application and incorporated herein by reference. While that invention was primarily concerned with the detection of web flutter and the production of a signal representative of the amplitude and frequency of such flutter, the present invention applies that signal in an apparatus and method for the suppression of web flutter and thus the prevention of web breaks.

Flutter is that phenomenon where the web moves in a direction substantially perpendicular to the direction of travel, which movement has one or more amplitudes and frequencies. Since touching the web during production is to be avoided, if possible, it would be desirable to detect and control web flutter in a fashion which does not contact the web. While copending application Ser. No. 192,255 detects web flutter in a non-contact fashion, the present invention suppresses web flutter in a non-contact fashion.

Devices have been previously disclosed for the determination only of web flutter in a non-contact fashion, while flutter suppression was attempted through direct contact with the web U.S. Pat. No. 4,496,428—Wells and related U.S. Pat. No. 4,501,642—Wells discuss the use of reflected light in order to determine the amplitude and frequency of web flutter during paper manufacture. Such information is thereafter used to change the movement or location of various rollers, i.e. modification of the web drive roller velocity or the reciprocation of a piston connected web contacting roller, so that tension in the paper web can be maintained at some desired level. Although this patent suggests the use of radar or ultrasonic devices for determining flutter, no method or apparatus is disclosed.

U.S. Pat. No. 4,637,727—Ahola et al. also discusses the use of light to make a non-contact determination of web flutter, however, no discussion appears as to how such flutter could be controlled. It is said in that patent that the minimization of flutter results in the probability of a web break being smaller. Basically, it appears that flutter amplitude and frequency are determined through the use of a high frequency distance measuring scheme. A light pulse is reflected off a moving paper web and directed onto a photodiode. The time it takes the light to travel from its source to the photodiode is measured. Over a period of time, sufficient measurements can be made to determine the frequency and amplitude of web flutter. This patent also suggests the use of capacitance or ultrasound to determine web flutter; however, for different reasons each of these techniques is rejected in favor of the light based technique.

One problem with these previously described devices is that they do not appear to be practical in the manufacturing environment. For example, in the manufacture of paper it will be necessary to determine flutter within web pockets where temperatures can reach 180° F. or higher. Also, if a web break occurs in or around the region where flutter is being determined the device being used can be struck either by the advancing web or by the end of the web, i.e. the break tail. The forces involved in such contacts can be significant enough to damage light based devices.

It is also a practice in web manufacturing that if flutter appears to be too severe such that a web break or excessive wrinkling is feared, the flutter is reduced by slowing the movement of the web through the machinery. As will be appreciated, the slowing of the web results in the manufacturing equipment being operated at less than capacity, which is economically undesirable.

Consequently, a need exists for method and apparatus to control web flutter in a manufacturing environment in a non-contact fashion.

SUMMARY OF THE INVENTION

An apparatus and method for suppressing flutter of a moving web in a web manufacturing operation is shown to include a sensor for sensing the pressure of air in a region proximate the web, which sensor generates a pressure signal representative of the air pressure, a signal processor connected to receive said pressure signal, for determining the amplitude and frequency of the flutter from the pressure signal and for generating a suppression signal representative of a second amplitude and frequency necessary to attenuate the air pressure; and an air modulator, positioned to modulate the air in the region proximate the web, which modulator receives the suppression signal and modulates air in response thereto in relation to the second amplitude and frequency so that flutter is attenuated. The modulator can be a speaker which is positioned to modulate the air proximate the web. In one embodiment the speaker is placed in an air supply duct and in another embodiment is placed in a web pocket.

DETAILED DESCRIPTION OF THE INVENTION

Although the present invention may be used to determine flutter in industries involved with web processing technology, for the purposes of illustration the invention will be described as used in a paper manufacturing operation.

In a paper manufacturing process a number of different operations are performed on a moving web at various stations. Although flutter can be measured in any one of those stations, the description will be limited herein to the determination and suppression of flutter in the dryer portion of a paper manufacturing process. In the dryer portion the objective is to evaporate residual moisture in the pressed web at an efficient rate and at low steam usage. Any edge cracks or wrinkles formed during such evaporation in the dryer can be the cause of web breaks in subsequent processing sections. Since web wrinkles are believed to be related to flutter, the characterization of the amplitude and frequency of flutter in the dryer can provide valuable web break prevention information.

Figure 1:
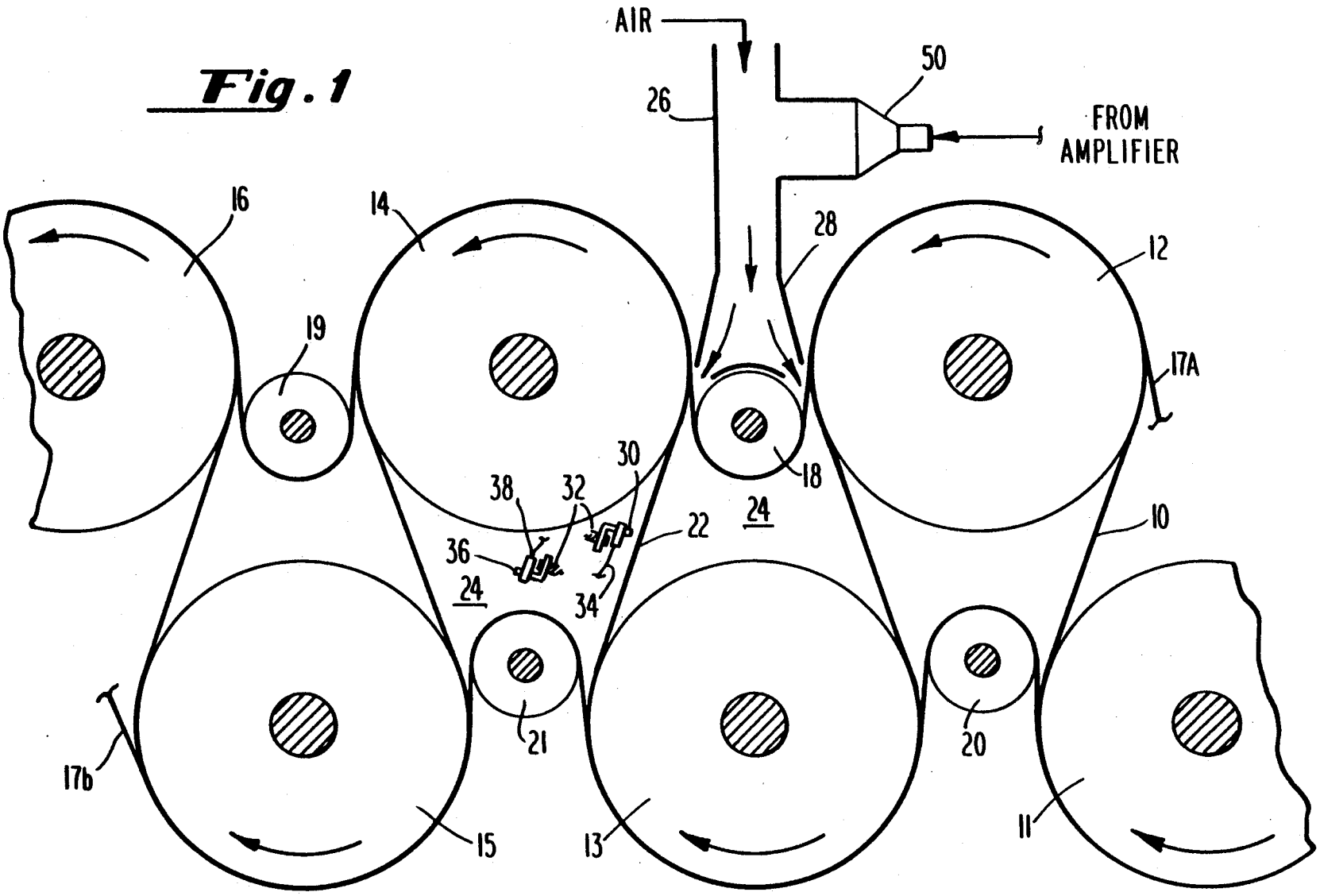
FIG. 1 is a diagrammatic plan view of a portion of a dryer used in a paper manufacturing operation.

As shown in FIG. 1, a wet paper web 10, which has been previously pressed and now contains approximately 60 percent moisture, is passed over a series of steam heated drying cylinders or cans 11, 12, 13, 14, 15 and 16. Typically, the cans are approximately 60 to 72 inches in diameter. Web 10 is held tightly against the cans 11–16 by a synthetic permeable fabric, so-called dryer felt 17*a* and 17*b*. Felt 17*a* presses web 10 against the surface of cans 12, 14 and 16 and passes over felt drying rolls 18 and 19. Likewise felt 17*b* presses web 10 against cans 11, 13 and 15 and passes over felt drying rolls 20 and 21. Although cans 11–16 and 18–21 are shown to be disposed on spindles, it will be understood that several techniques for rotational mounting are known and can be used.

In the drying operation, water is removed via a process whereby web 10 picks up sensible heat while in contact with steam heated cans 11–16 and thereafter flashes off steam in the so-called draw portion 22. This steam or water vapor is vented away within dryer pockets 24. Typically the venting of pockets 24 is achieved by passing heated dry air into a pocket through air permeable felts 17*a* and 17*b*. As shown in FIG. 1, air from a source not shown is supplied via duct 26 to a so-called box type vent 28. Vent 28 in turn directs the air onto and through felt 17*a* and into pocket 24. Although a box type vent is shown, it is within the scope of the present invention to use other known vent arrangements such as nozzle or roll type vents.

As web 10 passes through the dryer portion shown in FIG. 1, draw portion 22 will flutter within dryer pockets 24. A sensor 30, which may be mounted on an extension rod for relative stationary positioning, is shown to be mounted on frame 32 protruding into dryer pocket 24 in order to generate an electrical signal reflective of the amplitude and frequency of the flutter of the 13–14 draw, i.e., draw portion 22. The electrical signal is carried by leads 34 to processing components described in reference to FIG. 2.

While previous discussions of techniques to determine the amplitude and frequency of flutter have described complex and relatively delicate optical devices or have suggested other transmitting and receiving type equipment, it has been found that one can passively determine flutter without contacting the web by sensing the fluctuating or modulating air pressure in the region proximate the web. Since modulation of the air pressure in pocket 24 can originate from various sources other than web flutter, it may also be desirable to cancel out the effects of such other sources within the pocket where the amplitude and frequency of web flutter is being determined. In such situations two sensors can be utilized, wherein one sensor is positioned proximate web 10 and the other sensor is merely positioned within pocket 24 sensing the ambient air pressure within the pocket. To this end a second sensor 36 is illustrated mounted on frame 28 protruding into dryer pocket 24, in order to generate an electrical signal reflective of the amplitude and frequency of the air pressure within the dryer pocket. The electrical signal is carried by leads 38 to the processing components described in reference to FIG. 2, where the signal from sensor 36 is subtracted from the sensor 30 signal, so that the resulting signal is representative of sheet flutter. As discussed hereinbelow, this difference sensor signal provides a signal that is essentially proportional to acceleration of the sheet in the plane normal to its path of travel.

Figure 2:
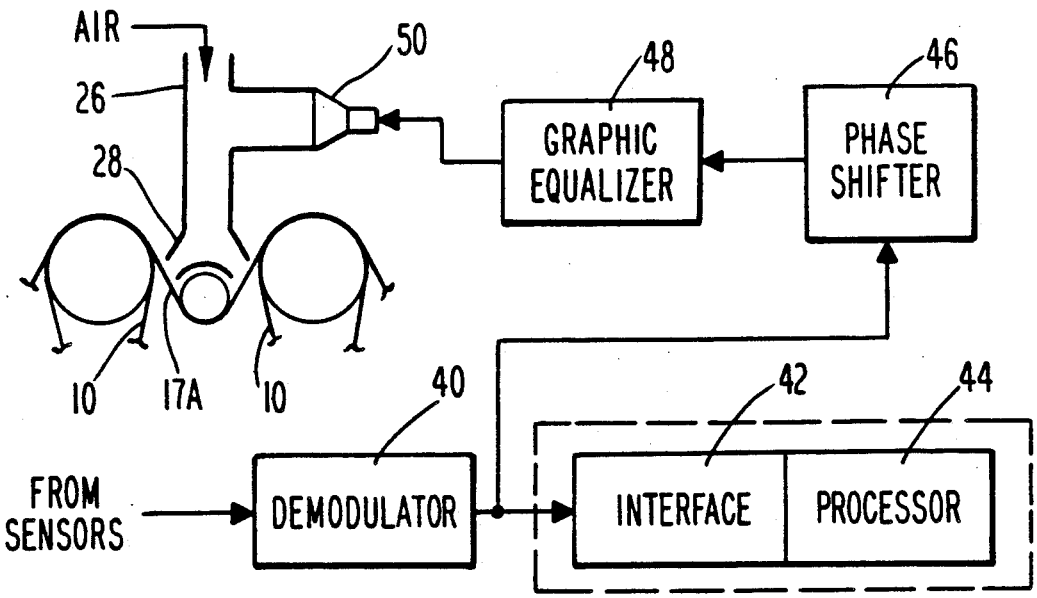
FIG. 2 is a functional diagram of the present invention.

Referring now to FIG. 2, as web 10 flutters the air pressure in the region proximate to the web will modulate in proportion to such flutter. Sensor 30 senses the air pressure in the region proximate to the web and generates an electrical signal which is reflective of the modulating air pressure, which signal in turn is also reflective of the amplitude and frequency of the flutter. In the preferred embodiment sensor 30 includes a low differential pressure transducer such as the DP45 sold by Validyne Engineering Corporation of Northridge, Calif. Although such transducers are particularly specified for determining low differential air pressure conditions, such as that found in so-called "clean room" applications, it has been discovered that this transducer is also useful to detect modulating air pressure in one of the pockets of a paper manufacturing dryer, where flutter frequency is believed not to exceed approximately 100 Hz. This transducer is also preferred because of its ability to withstand not only the environment in a paper manufacturing operation, but also its believed ability to withstand the consequences of a web break. For a more detailed description of the specific structure of the sensors, reference is again made to copending application Ser. No. 192,255.

Referring again to FIG. 2, the signal generated by sensor 30, from which the signal from sensor 36 is subtracted, is a modulated electrical signal which is connected to demodulator 40, which demodulates the difference sensor signal. Thus, the signal from demodulator 40 is a real time analog signal which represents the time varying air pressure produced by the web flutter pocket 24. In the preferred embodiment, demodulator 40 is a CD12 Transducer Indicator sold by Validyne Engineering Corporation of Northridge, Calif.

Figure 3:
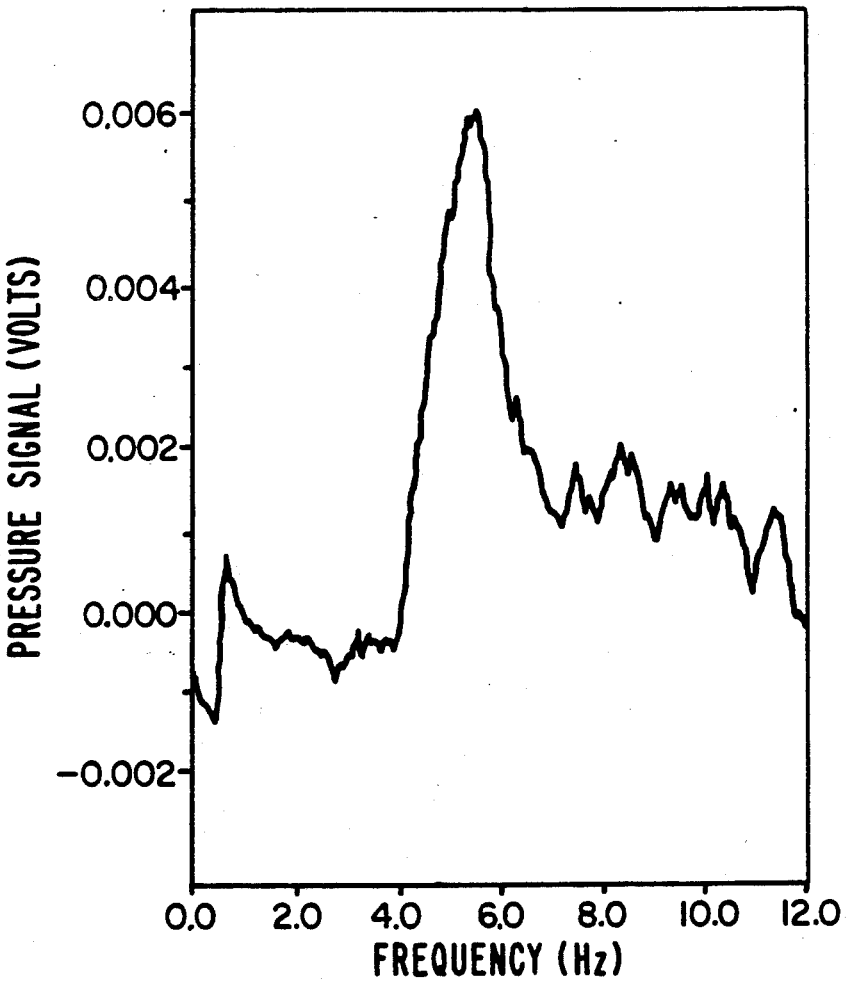
FIG. 3 is a graph of the amplitude and frequency of typical paper web flutter.

In order to inspect the characteristics of the demodulator output circuit, I have analyzed it with the diagnostic processing equipment indicated at blocks 42, 44 of FIG. 3. Interface 42 is a R300 Digital Signal Processor interface board sold by Rapid Systems, Inc. of Seattle, Wash. Such interface boards are designed for insertion into so-called "desk top" computers such as those made by IBM Corporation of Poughkeepsie, N.Y. or so-called "IBM compatible" computers with 640 kBytes of random access memory. Processor 44 in the preferred embodiment can be such a computer operated with the R360 Real time Spectrum Analyzer software, also sold by Rapid Systems, Inc. Processor 44 can be replaced by any dedicated vibration analyzer capable of processing low frequency vibrations, i.e. vibration frequencies as low as 0.10 Hz. Processor 44 is used to perform a fast Fourier transformation on the demodulated signal passing through interface 42, transforming the signal from the time domain to the frequency domain. Such a transformation provides an output which is directly indicative of frequency and sheet acceleration. Since the sensor signal input is essentially proportional to web acceleration, it is necessary to integrate this signal twice to convert the acceleration-based signal to displacement, or true amplitude. For a periodic signal, this mathematical operation can be achieved simply by dividing the voltage signal by the square of the corresponding frequency.

Processor 44 is thus utilized to perform the transformation and generate an indication signal, similar to that shown in FIG. 3, representative of the amplitude and frequency of the sensed flutter over a predetermined time period. As illustrated in FIG. 3, the flutter is seen to have a number of frequencies (shown along the X axis), with each frequency having a corresponding amplitude. From this the objective of the invention is derived, namely to produce a feedback signal which corresponds in its frequency transform, but which has the energy at each frequency shifted in phase so as to oppose the flutter.

Referring back to FIG. 2, in the actual practice of this invention the analog signal from demodulator 40 is connected to phase shifter 46, which suitably is a combined amplifier-phase shifter. Phase shifter 46 is designed to modify its received signal to generate a negative feedback signal for attenuating the flutter. As seen from FIG. 3, most of the frequencies involved are below normal audio range, and thus phase shifter 46 must be adapted to process a frequency range of about DC to 12–20 Hz, and must be tunable to provide an optimum phase shift at each frequency. Such amplifiers are well known in the art. Theoretically the signal would shifted about 180° at each frequency, to generate a signal to attenuate the flutter. However, there are numerous factors which contribute to the amount of phase shift necessary to generate a signal which can attenuate the web flutter. The signal generated by phase shifter 46 should be sufficiently out of phase that when the air in pocket 24 is modulated in relation to this signal, the flutter-caused air modulation is substantially cancelled or attenuated, thereby minimizing the web flutter. In other words, phase shifter 46 is adjusted to provide a signal which yields substantially a 180° closed loop feedback at each significant frequency. In order to aid this objective, a graphic equalizer 48 may also be utilized. Additional amplification can also be added as needed.

In order to modulate the air in pocket 24 in a negative fashion with respect to the air modulation caused by web flutter, the feedback signal is connected to a suitable speaker, or horn 50. Signal speaker 50 can be of any design able to handle low frequencies up to about 100 Hz, and also must be capable of use in the manufacturing environment. The purpose of the speaker is to transform the feedback signal into air pressure variations which counter those produced by the flutter, and thus dampen the flutter. By positioning speaker 50 in fluid communication with duct 26, the air moving through duct 26 can be modulated in accordance with the feedback signal. Since the air in duct 26 is supplied to pocket 24, it serves to modulate the air in pocket 24 in a fashion which either attenuates or cancels flutter caused modulation, thereby attenuating or suppressing web flutter. In operation it may be necessary to adjust the feedback signal connected to horn 50, in order to take into account other phase shifts around the loop, so as to achieve maximum suppression of web flutter. For example, any phase shift between the air waves generated at the horn and the air waves at the web must be accounted for.

Figure 4:
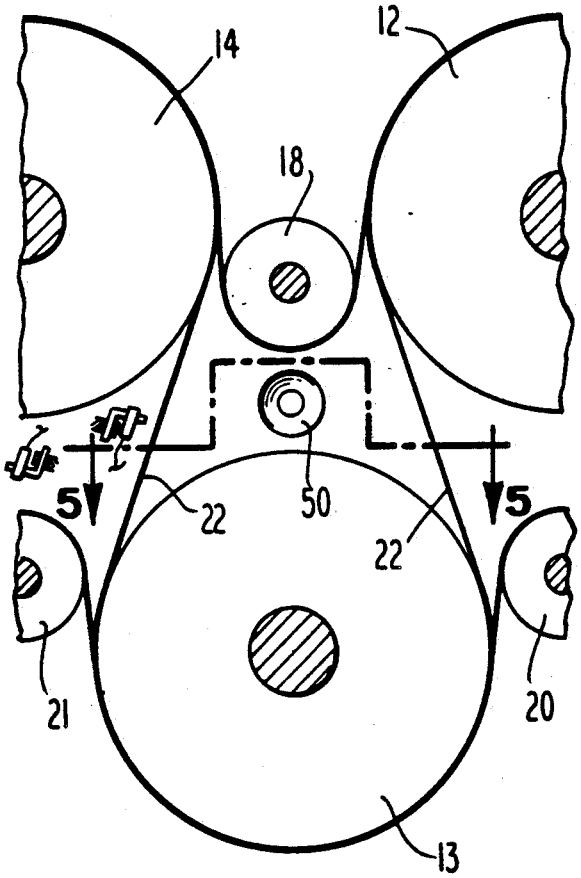
FIG. 4 is a plan view of a portion of a dryer incorporating an alternate embodiment of the invention.
Figure 5:
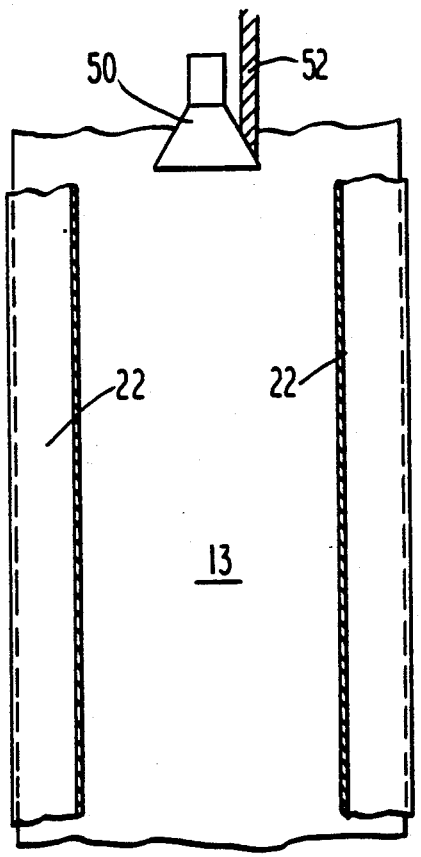
FIG. 5 is a section view along the line 5—5 shown in FIG. 4.

Referring now to FIGS. 4 and 5, an alternate placement of speaker 50 is depicted. In this embodiment, speaker 50 is mounted to frame 52 and positioned so that the output of speaker 50 directly modulates the air in pocket 24. In this embodiment it is important to select a speaker which can withstand the dryer environment as well as the consequences of a web break, i.e. being struck by the web.

In either of the previously described embodiments it can be seen that during operation the signals from the sensors serve to provide an error signal. It thus becomes the objective of the phase shifter and/or equalizer or equivalent feedback signal generating means, to generate a signal which minimizes the error signal. In practice, the phase shift introduced by the feedback signal generating means, as well as the amplitude of the feedback signal, are adjusted to minimize the sensor error signal.

While the invention has been described and illustrated with reference to specific embodiments, those skilled in the art will recognize that modifications and variations may be made without departing from the principles of the invention as described herein above and set forth in the following claims.

What is claimed is:

1. A method for suppressing flutter of a moving web in a web manufacturing operation, wherein said web flutter acts to modulate air pressure proximate said web, comprising the steps of:

passively sensing air pressure proximate said web caused by said web flutter without contacting the web and generating a web flutter signal representative of the modulating air pressure caused by said web flutter;

deriving a phase-shifted suppression signal from said flutter signal, said suppression signal being phase-shifted substantially across its frequency spectrum to provide a negative feedback signal relative to said flutter signal; and negatively modulating the air pressure proximate said web with a speaker in response to said suppression signal which negative modulation substantially cancels the air pressure modulation caused by said web flutter so that said flutter is attenuated without contacting said web.

2. The method of claim 1, wherein said web manufacturing operation includes supplying air to said region proximate said web, and wherein said step of modulating said air in said region comprises the step of modulating the air in said air supply means.

3. The method of claim 1, further comprising adjusting said suppression signal to account for phase shifts introduced other than in said deriving step.

4. The method of claim 1, comprising monitoring said pressure signal, and adjusting said suppression signal to minimize said pressure signal.

5. The method of claim 4, wherein said adjusting comprises adjusting phase and amplitude of said suppression signal.

6. An apparatus for suppressing flutter of a moving web in a web manufacturing operation, wherein air is supplied to said web and wherein said web flutter acts to modulate air proximate said web, comprising:

a sensor for passively sensing air pressure proximate said web caused by said web flutter without contacting said web and for generating a web flutter signal representative of the fluctuating air pressure caused by said web flutter;

a signal generator, connected to receive said web flutter signal, for generating a suppression signal derived from said web flutter signal; and an air modulator comprising a speaker, positioned to modulate the air supplied to said web, for receiving said suppression signal and for negatively modulating the air supplied to said web in response to said suppression signal, wherein the negatively modulated air supplied to said web with the speaker substantially cancels the flutter based air pressure modulation so that said flutter is attenuated without contacting said web.

7. A method for suppressing flutter of a moving web in a web manufacturing operation, wherein air is supplied to said web and wherein said web flutter acts to modulate air proximate said web, comprising the steps of:

passively sensing air pressure proximate said web caused by said web flutter without contacting said web and for generating a web flutter signal representative of the fluctuating air pressure caused by said web flutter;

deriving and generating a suppression signal from said web flutter signal; and negatively modulating the air supplied to said region proximate the web with an air modulator comprising a speaker in response to said suppression signal, wherein the negatively modulated supplied air substantially cancels the flutter based air modulation so that said flutter is attenuated without contacting said web.

* * * * *